United States Patent [19]

Simo et al.

[11] Patent Number: 4,487,687

[45] Date of Patent: Dec. 11, 1984

[54] METHOD OF PROCESSING HEAVY HYDROCARBON OILS

[75] Inventors: Thomas Simo, Bad Homburg; Karl-Heinz Eisenlohr, Dreieich, both of Fed. Rep. of Germany

[73] Assignee: Metallgesellschaft AG, Frankfurt am Main, Fed. Rep. of Germany

[21] Appl. No.: 342,315

[22] Filed: Jan. 25, 1982

Related U.S. Application Data

[63] Continuation-in-part of Ser. No. 151,053, May 19, 1980, abandoned.

[30] Foreign Application Priority Data

May 19, 1979 [DE] Fed. Rep. of Germany ..... 2929415

[51] Int. Cl.[3] ..... C10G 49/20; C10G 65/12

[52] U.S. Cl. ..... 208/56; 208/107; 208/126; 208/251 H

[58] Field of Search ..... 208/53, 56, 58, 107, 208/126, 127, 251 R, 253, 251 H

[56] References Cited

U.S. PATENT DOCUMENTS

| | | | |
|---|---|---|---|
| 3,238,118 | 3/1966 | Arey, Jr. et al. | 208/59 |
| 3,362,901 | 1/1968 | Stepe et al. | 208/86 |
| 3,769,200 | 10/1973 | Folkins | 208/53 |
| 4,294,686 | 10/1981 | Fisher et al. | 208/56 |
| 4,334,976 | 6/1982 | Yan | 208/8 LE |

FOREIGN PATENT DOCUMENTS

| | | | |
|---|---|---|---|
| 1073389 | 3/1980 | Canada | 208/126 |
| 99995 | 7/1980 | Japan | 208/126 |
| 723629 | 2/1955 | United Kingdom | 208/53 |

*Primary Examiner*—Delbert E. Gantz
*Assistant Examiner*—O. Chaudhuri
*Attorney, Agent, or Firm*—Sprung Horn Kramer & Woods

[57] ABSTRACT

Heavy hydrocarbon oil to be processed is subjected to a treatment at elevated temperature and superatmospheric pressure in the presence of dispersed solids and molecular hydrogen and recycled hydrogen donor oil. By this treatment, a certain part of the asphaltenes absorbed on the solids may be coked. The product of that donor solvent hydrovisbreaking (DSV) is distilled. The distillate or distillates is or are catalytically hydrogenated. The visbreaking residue is used for the production of hydrogen. The hydrogenated products are separated in hydrocarbon fractions and are then processed further to fuels and/or petrochemical products and a part of the hydrogenated products is recycled as inherent donor solvent.

3 Claims, 1 Drawing Figure

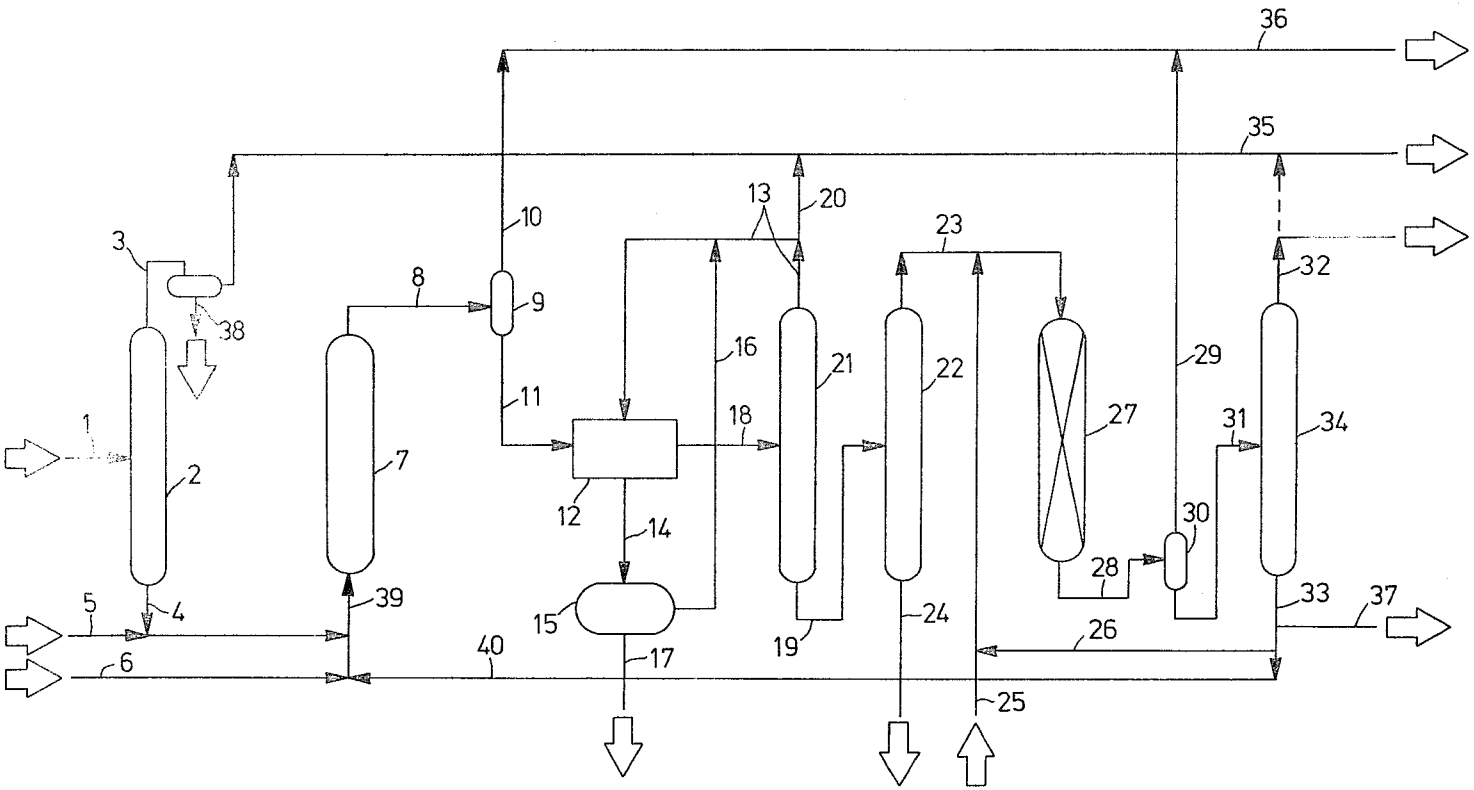
1
2
3
4
5
6
7
8
9
10
11
12
13
14
15
16
17
18
19
20
21
22
23
24
25
26
27
28
29
30
31
32
33
34
35
36
37
38
39
40

METHOD OF PROCESSING HEAVY HYDROCARBON OILS

CROSS REFERENCE TO RELATED APPLICATION

This is a continuation-in-part of copending application Ser. No. 151,053 filed May 19, 1980, now abandoned, entitled "Method of Processing Heavy Hydrocarbon Oils".

BACKGROUND OF THE INVENTION

1. Field of the Invention

This invention relates to a method of processing heavy hydrocarbon oils, such as crude oil, crude oil residue, shale oil, tar sand bitumen, liquid conversion products obtained by the hydrogenation, gasification and degasification of coal, which oils may contain asphaltenes, heavy metals and/or other catalyst poisons, such as arsenic, antimony, selenium and the like, to produce fractions which boil below the feedstock and are subsequently processed to fuels and/or petrochemical products, such as olefins, aromatic compounds, etc.

2. Discussion of Prior Art

The known methods of processing heavy hydrocarbon oils which have very high contents of high-boiling components or asphaltenes, heavy metals and/or elements of the arsenic group are not satisfactory and not sufficiently flexible regarding the yield-distribution and the removal of metals.

It has been proposed to process such feedstocks by an expensive catalytic hydrogenation in the liquid phase and/or by de-asphaltization whereby asphaltenes are converted, catalyst poisons are removed and products are obtained which can be processed further by known methods.

These proposals have the disadvantage that the catalytic hydrogenation in the liquid phase involves the need for regenerating the catalyst and that this can be accomplished only with great difficulty if the feedstock has extremely high contents of asphaltenes, metals and trace elements. The use of one-way-catalysts necessarily involves besides the loss of the catalyst hydrocarbon oil losses since the latter must be recovered from the waste sludge formed by the hydrogenation in the liquid phase. Additionally, the activity of the one-way catalysts in question is often insufficient so that the performance of the process is adversely affected.

It is also known to de-asphaltize the heavy hydrocarbon oil for a recovery of hydrocarbon oils which are substantially free from asphaltenes and can be processed further. These processes involve the disadvantage that the yields are substantially restricted and an excessively large asphalt fraction is formed, which offers only a few possibilities for further processing. These proposals do not ensure the required removal of metals and trace elements if the feedstocks have very high contents of asphaltenes, metal and/or other trace elements which constitute catalyst poisons (Offenlegungsschrift Nos. 2,504,487; 2,508,488; 2,644,721 and 2,726,490).

It is an object of the invention to avoid these disadvantages of the prior art and to provide a process which can be carried out in a simple manner and with which the quality requirements set forth can be met with a high yield.

SUMMARY OF THE INVENTION

The objects are accomplished in accordance with the present invention which provides a process for converting heavy hydrocarbon oils containing asphaltenes, and/or metals to lighter, useful hydrocarbons comprising A. adding solids to said heavy hydrocarbon oil in the presence of a donor solvent said solids serving as a support for asphaltenes and/or metals present in said heavy hydrocarbon oil and subjecting said heavy hydrocarbon oil containing solids to hydrovisbreaking by contacting the same at an elevated temperature and superatmospheric pressure with hydrogen in the presence of a donor solvent under non-agglomerating conditions; or B. subjecting said heavy hydrocarbon oil to hydrovisbreaking by contacting the same at an elevated temperature and superatmosoheric pressure with hydrogen in the presence of a donor solvent under closely controlled conditions and forming solids by coking of a certain proportion of said heavy hydrocarbon oil, said solids serving as a support for asphaltenes and/or metals in said heavy hydrocarbon oil;

C. distilling the product of said hydrovisbreaking to remove a distillate or a plurality of distillates and leave behind a residue;

D. hydrogenating at least one of said distillates catalytically;

E. separating from said catalytically hydrogenated products from step D, the hydrocarbon fractions of lower boiling point than said distillate fed into step D and F. recycling at least a part of the residue of said distillation of step C as donor solvent.

Thus, the invention contemplates a process for converting heavy hydrocarbon oils containing asphaltenes and/or metals to lighter, useful hydrocarbons which comprises subjecting said heavy hydrocarbon oil containing solids, especially those solids which entirely or substantially consist of carbon, to hydrovisbreaking by contacting the same at elevated temperature and superatmospheric pressure with hydrogen in the presence of a donor-solvent under non-agglomerating conditions whereby a certain proportion of asphaltenes can be coked, distilling the product of said hydrovisbreaking to remove a distillate or a plurality of distillates and to leave behind a residue, catalytically hydrogenating said distillates or plurality of distillates, separating said catalytically hydrogenated products into hydrocarbon fractions of lower boiling point than said heavy hydrocarbon oil and converting the residue into hydrogen.

The solids, especially those solids which entirely or substantially consist of carbon, can be either added to the heavy hydrocarbon oil or can be formed in situ by coking a portion of the heavy hydrocarbon containing feedstock, thereby to generate carbonaceous solids in situ. Generally speaking, this coking is effected prior to the hydrovisbreaking.

In carrying out the process where solids are added to the heavy hydrocarbon oil, it is preferred that they be added in amounts up to 5% by weight of the liquid contents of the reactor, particularly up to 2% by weight of the liquid contents of the reactor.

The hydrovisbreaking of step A is generally carried out at a temperature of 380° to 450° C. under a total pressure of 40 to 200 bars at a liquid hourly space velocity of 0.5 to 2 kg/l-h, preferably 0.8 to 1.5 kg/l-h, employing a recycle gas rate of 400 to 2000, preferably 800 to 1200, standard cubic meters per metric ton of the entire liquid feed.

In the presence of added solids the hydrovisbreaking is carried out under non-agglomeration conditions. These non-aggomeration conditions depend on the nature of the heavy hydrocarbon oil being processed and mean conditions of severity which are not allowed to exceed. On the other hand, agglomeration can be inhibited by adding components into the visbreaker reactor which are non-catalytic inert solids. These solids are either entirely carbon or substantially consist of carbon and act as a support for asphalt contained within the heavy hydrocarbon oil or metals present therein. Alternatively, where the heavy hydrocarbon oil contains a solid itself, as in the case of shale oil, those solids, which are generally non-catalytic inert ones of mineral origin, prevent agglomeration as well. They also serve as carriers for asphalt and metals present in the heavy oil. Generally speaking, agglomeration is precluded by the copresence of these solids. However, with certain feedstocks and with the introduction of the appropriate donor solvent oil, the presence of extraneous solids is necessary in a low amount only since the donor solvent itself extends the limit of severity.

Following the hydrovisbreaking the so-treated product is subjected to a step for the removal of $C_5^-$ hydrocarbons which can be followed by a step or series of steps to remove any solids present. Thereafter, the liquids are treated to remove naphtha and other distillates which can be hydrogenated to provide desirable, useful lower boiling hydrocarbons. This subsequent distillation can be carried out as a series of distillations wherein a first distillation, carried out at atmospheric pressure, provides visbreaker naphtha and a second distillation off the residue (visbreaker oil) is carried out under vacuum conditions to provide medium and heavy distillates.

The distillates are generally hydrogenated in the presence of a catalyst in a reaction zone which provides maximum contact of hydrogen gas with the hydrocarbon distillates, such as a trickle bed reactor. Hydrogenation conditions include a temperature of from 320° to 450° C., preferably a temperature of 360° to 410° C., a hydrogen pressure of 100 to 250, preferably 130 to 175 bars, and a liquid hourly space velocity of 0.5 to 2, preferably 0.8 to 1.5 kg/l-h. Catalysts useful for this hydrogenation include known hydrogenation catalysts such as those containing cobalt, molybdenum, nickel, vanadium, tungsten and their sulfides. The catalysts are generally solids wherein the catalytic component is disposed on a solid support.

The hydrovisbreaking is carried out in the presence of a donor-solvent oil. Preferably, the donor-solvent oil is one obtained from the hydrogenation of the distillates as discussed, supra. The effluent of the hydrogenation is in turn subjected to a further distillation from which there is derived the donor solvent oil which is employed in step A, wherein the heavy hydrocarbon oil is subjected to donor-solvent hydrovisbreaking.

The amount of donor solvent oil charged into the visbreaker reactor is 10 to 100, preferably 15 to 35 weight percent, based upon the weight of the heavy hydrocarbon oil to be visbroken. This donor solvent is a hydrocarbon oil containing naphthenes, especially naphthenes in an amount of at least 20 weight percent, preferably 20 to 50 weight percent. The donor solvent employed has a boiling point in the range of 200° to 500° C. and preferably 260° to 420° C.

The distillation of the hydrovisbreaker effluent is effected to obtain visbreaker naphtha and a distillate or plurality of further distillates having a boiling range of 200° to 500° C. These later distillates when hydrogenated form products useful as gasoline and diesel fuel stocks, all as more fully discussed below.

Within the scope of the invention the donor solvent hydrovisbreaking (DSV) can also be considered as carried out in the presence of atomic hydrogen, produced in situ by cleavage of hydrogen from naphthenic C—H bonds.

The naphthene content of the donor solvent oil may be so high that the hydrogen obtained by cleavage as explained above is sufficient to effect a satisfactory decomposition of asphaltenes and for the removal of metals in conjunction with a very low amount of coking whereas the simultaneous conversion of the naphthenes to aromatic compounds does not change the dissolving power of the donor oil for asphaltenes.

In the case when the feedstocks contain inert solids of mineral origin, as e.g. shale oils, the donor-solvent hydrovisbreaking can be advantageously carried out without an addition of further solids so that the inherently present solids serve as supports for asphalt and metal.

It is also advantageous to treat solids free of or solids containing heavy oil by the donor-solvent hydrovisbreaking according to the invention in the presence of additional solids which consist entirely or substantially of carbon to avoid an excessive ash content in the visbreaker residue. The suitable dispersed carbonaceous solids consist of coke which has been formed by the coking of the visbreaker residue or of coal, wood, peat, coconut shells, lignin, etc.

Depending on the origin of said coke, it may be desirable to change the surface area and pore structure of the same by partial gasification so that its absorption capacity for asphaltenes is increased. Alternatively, the coal or the like may be degasified in the presence of activating substances, such as $ZnCl_2$, $SnCl_2$, and may be subsequently coked.

The concentration of the dispersed solids in the visbreaker reactor is uniform along the reactor and suitably amounts up to 5% by weight, preferably up to 2% by weight, of the liquid contents of the reactor.

Where these measures are adopted, the hydrovisbreaking can be carried out in such a manner that the elements of the arsenic group are completely removed and a satisfactory demetallization is effected whereas losses by coking need not be accepted. On the other hand, it can be advantageous to carry out the treatment above the coking temperature limit and to coke a certain proportion of the high-molecular asphaltenes which have been absorbed on the surface of the support. Said in situ produced solid comprises coke and is allowed to reach an amount up to 5%, preferably up to 2% by weight, of the liquid contents of the reactor. As a result, the heavy metals will be preferently deposited. 0.1 to 5% by weight of the total carbon content of the hydrocarbons may be coked. A further option according to the invention is to use coke as support for high-molecular asphaltenes which coke is generated in situ entirely by controlled partial coking of the feedstock as stated above.

The visbreaker distillates obtained according to the invention are free from asphaltenes, heavy metals and elements of the arsenic group and can be treated in fixed-bed units for catalytic hydrogenation and further processing. With feedstocks containing more than 1% by weight oxygen, such as tar distillates, the fixed-bed hydrogenation may be carried out with the recycling of a suitable fraction of its effluent so that the heat which is released by the hydrogenation can be technically controlled.

Feedstocks having a relatively high content (more than 0.5% by weight) of nitrogen combined in cyclic compounds may also be advantageously processed if that measure is adopted. The equilibrium between the relatively high concentration of ammonia on the surface of the catalyst, on the one hand, and the loading of the catalyst with unreacted, diluted feedstock, on the other hand, is reestablished.

The advantages offered by the method according to the invention over the known proposals reside in that the problems involved in the regeneration of the catalyst for a liquid-phase hydrogenation are eliminated, the yield is not restricted by losses of oil in the sludge discarded with catalyst and the conditions of the donor-solvent hydrovisbreaking depend no longer on an inactivation of the catalyst. The invention permits also an optimum demetallization and removal of trace elements under mild conditions. Additionally, the yields can be controlled so that the visbreaker residue becomes available at the rate required for the production of hydrogen.

Further advantages offered by the method according to the invention over the known methods reside in that the de-asphalting is replaced by a distillative removal of the residue so that a more reliable demetallization without restriction of the yields is ensured. Besides, a much simpler processing is enabled.

BRIEF DESCRIPTION OF DRAWING

Referring to the annexed drawing, the same is a flow diagram of a suitable scheme for practicing the process of the invention. The gas cycles and the heat exchange-, pressure-, handling- and pressure relief-systems have been omitted. This illustration does not preclude the use of elements of the method according to the invention in other useful combinations, which may be obvious to a person skilled in the art.

DESCRIPTION OF SPECIFIC EMBODIMENTS

In accordance with the invention, heavy crude oils, crude oil residues or bitumen derived from tar sand, which do not contain or have only low contents of distillable constituents, are processed as follows. These feedstocks have in common that they are highly susceptible to coking and have relatively high contents of heavy metals bonded organic compounds as well as asphaltenes.

The feedstock 1 is separated in a vacuum distillation stage 2 into straight-run distillate 3 and vacuum distillation residue 4. If the feedstock consists of water-containing crude oil, the same is dewatered and desalted previously; steam 38 indicates the separation of excessive water if any is present. The vacuum distillation residue 4 is fed to the visbreaker 7 together with finely ground coke 5, recycle oil 40 and molecular hydrogen 6.

The coke is admixed in an amount of 1 to 3% by weight of the total liquid feed 39 supplied to the visbreaker. The mixing ratio of residue to recycle oil may amount to 1:1, e.g., and is selected so that the recycle oil with its actual naphthene content can act as a hydrogen donor so that the formation of coke under the conditions in the visbreaker will remain within preselected limits.

$C_5-$ hydrocarbons 10 are separated in a stabilizer 9 from the effluent 8 withdrawn from that donor solvent hydrovisbreaking stage. In special cases, e.g., when the feedstock has inherently a high solids content, such as it is in the case of shale oil (about 5 to 25% by weight solids) or of tar sand bitumen, the solids may be removed 12 from the stabilized liquid visbreaker effluent 11 for example by solid-liquid separation steps effected by centrifuges and subsequent extraction of the sludge with recycled visbreaker naphtha 13. The naphtha-containing concentrated solids 14 are evaporated to dryness in stage 15. The naphtha 16 is recycled and the dry solids 17 are discharged.

As a result of this processing of shale oils, the original As/Sb/Se contents of the feedstock oil are found in the form of sulfides on the solids. No carbon is lost by coking and no coke is discharged with the solids. The solids have substantially the same composition as the inorganic contents of the oil shale after some carbonates have been decomposed.

On the other hand, if the feedstock contains originally less than 5% by weight of solids or no solids as is the case with the above-mentioned heavy crude oils or crude oil residues, the stabilized visbreaker effluent 11 may be fed as stream 18 directly to the atmospheric distillation stage 21 for separation into visbreaker naphtha 13 and visbreaker oil 19. If this distillation stage is operated at a cut point above 200° C., a light visbreaker gas oil rather than naphtha can be recovered.

In the vacuum distillation stage 22, the visbreaker oil 19 is separated into distillate 23 and residue 24. The distillate can be recovered in a plurality of fractions or an overall distillate can be obtained up to a boiling point of, e.g., 480° C. and a vacuum residue, which becomes available at such a rate that all hydrogen required in the entire processing can be produced by the gasification of the residue. That residue amounts usually to 8 to 15% by weight of the feedstock oil and contains added or in situ generated coke. This gasification can be done under known gasification conditions, using, for example, steam and oxygen as gasification media. The temperature in the gasification zone can be 1400° C., the pressure about 60 bar, and the residence time 10 to 15 seconds.

Hydrogen 25 and, if desired, recycled oil 26 are added to the vacuum distillate 23, which is then hydrogenated in a trickle bed reactor 27. The following conditions may be selected, e.g., for this reaction: Overall pressure 140 bars, exit temperature 420° C., liquid hourly space velocity 1.5 kg/l-h, gas circulation rate 1200 standard $m^3$ per metric ton of liquid feed.

Using commercial hydrogenation catalysts which contain one or more components of the group Co, Mo, Ni, V, W and the sulfides thereof, which components have hydrogenating activity, the effluents from the fixed-bed hydrogenating stage can be treated in the stabilizer 30 to remove the $C_5-$ fraction 29 and to provide a stream 31 which in the atmospheric distillation stage 34 is separated into hydrotreated gasoline 32 (motor gasoline component) and diesel oil 33.

These product streams may alternatively be converted into petrochemical products by known methods. By the selection of the conditions in the distillate-hydrogenating stage 27 the distribution of yields can be controlled within wide limits depending on the demands for petrochemical raw materials or on the fuel which is desired or the process by which it is processed further. Stream 32 may be combined with streams 3 and 20 or may be processed separately. Part of the fraction 33 may be recycled through the fixed-bed hydrogenation stage. Furthermore, fraction 33 can be suitable as the donor recycle oil 40 as well, if the conditions in the hydrotreater are adjusted accordingly.

When the fixed-bed hydrogenation stage shown on the drawing is operated to produce diesel oil, representative yields stated hereinafter in % by weight can be obtained:

| | |
|---|---|
| 35: Raw naphtha + visbreaker naphtha | 24 parts by weight |
| 32: Hydrogenated naphtha | 9 parts by weight |
| 36: $C_5^-$ hydrocarbons | 1 parts by weight |
| 37: Diesel oil | 66 parts by weight |
| | total 100 parts by weight |

When the method shown by way of example is used to process a paraffinic heavy crude oil residue, the hydrovisbreaker may be operated under the following conditions: Exit temperature 380° to 450° C., e.g., 425° C., total pressure 140 to 175, e.g., 150 bars, liquid hourly space velocity 0.8 to 1.6 kg/l-h; recycled gas rate 600 to 1600, e.g., 1000 standard $m^3$ per metric ton of liquid feed, coking rate 2% by weight of residue feedstock.

The coke 5 which is used in the hydrovisbreaking as a support for the asphalt and metal is usually formed by the coking of the residue 24 or from other coking plants. Coke which has been obtained by the degasification pyrolysis, carbonization of the residue or coal or similar materials having different pore structures is also suitable in many cases. In case of need the coke may be activated, e.g., by an additional partial gasification, in order to increase its pore size and pore volume.

The visbreaker residue 24 contains coke which has been formed by the partial coking during the hydrovisbreaking or has been added prior to the hydrovisbreaking and all metals deposited on that coke.

The residue of the last distillation stage 34 is recycled in the present example as donor oil to the visbreaker. For this reason that distillation is carried out in such a manner that naphtha and light gas oil or diesel oil are withdrawn as distillate 32. The separtion of the fuel component from the combined straight-run-distillate 3, visbreaker naphtha or gas oil 20 and the distillate 32 or the petrochemical processing are then carried out (in further steps) downstream.

EXAMPLES

For the further illustration of the process according to the invention, results of autoclave experiments will now be described, which permit of conclusions regarding the yield ratios in a continuous process.

EXAMPLE I

The products were processed in accordance with the drawing. A heavy crude oil, which contained 40% by weight of distillable constituents, 505 ppm vanadium, 9.3% by weight of asphaltenes, was subjected to donor solvent hydrovisbreaking. Typical conditions of the reaction in a stirred autoclave were:

| | |
|---|---|
| Feedstock: | Residue from vacuum distillation of crude oil and recycled donor oil obtained by catalytic hydrogenation of visbreaker oil |

-continued

| | |
|---|---|
| Mixing ratio: | 1:1 |
| Naphthene content of donor oil: | 30% by weight |
| Boiling range of donor oil: | 220 to 460° C. |
| Total pressure: | 140 bars |
| Residence time: | 1 hour |
| Temperature: | 425° C. |
| Rate of hydrogen, which was passed continuously: | 400 standard liters per kg of liquid content of autoclave |

In the experiments which are reported here by way of example, different solids were added for use in the solvent visbreaking as supports for asphalt, coke and metal. The yields have been designated with the numbers used on the drawing for the streams.

| Solids (support) | None | Red mud | Coke |
|---|---|---|---|
| Solids content, % by weight | — | 5 | 5 |
| Yields in % by weight of crude oil 1 | | | |
| Distillates 3 + 20 + 32 | 75 | 81 | 87.5 |
| Residue 24 | 19 | 15 | 11 |
| $C_5^-$ hydrocarbons 10 + 29 | 6 | 4 | 1.5 |
| Coke formation (contained in residue) | 7 | 6 | 1.6 |

The distillates were free from metal.

CONTROL EXAMPLE

The entire crude oil was subjected to hydrovisbreaking under the same reaction conditions but without an addition of donor solvent and of a support for asphalt and metal. The yields amounted to 63% by weight of distillate corresponding to the combined amount of distillate 3, 20 and 32 and 36% by weight of residue 24; the latter contained 9% coke; based on the weight of the crude oil feedstock.

The heavy crude oil treated in accordance with the invention has an initial boiling point of 200° C.+. It generally has a relatively high asphaltene content of 1 to 8 weight percent. Other characterstics include: above 500° C. boiling components (not distillables) amount of 70%, by weight, CCR of the vacuum residue (500° C.$^{30}$ ) amounts up to25% by weight, unusual high content of organic bonded metals, the sum of which can amount in the range of 100 to 2000 ppm; each of these characteristics describes heavy oils which are not suitable for conventional processing.

What is claimed is:

1. A process for converting heavy hydrocarbon oils containing asphaltenes and/or metals to lighter, useful hydrocarbons, comprising:

A. adding finely ground coke to said heavy hydrocarbon oil, said coke serving as a support for asphaltenes and/or metals present in said heavy hydrocaarbon oil;

B. mixing said heavy hydrocarbon oil containing said coke with a donor solvent and with molecular hydrogen and subjecting the mixture to hydrovisbreaking, the amount of coke in said mixture being 1 to 3 percent by weight of the total liquid feed supplied to hydrovisbreaking, the amount of donor solvent being 15 to 35 percent by weight of the heavy hydrocarbon oil of said mixture, said donor solvent containing 20 to 50 percent by weight of naphthenes;

C. in said hydrovisbreaking said mixture being contacted at a temperature of 380° to 450° C. and a pressure of 140 to 175 bars with hydrogen under non-agglomerating conditions; in said hydrovisbreaking liquid hourly space velocity being 0.5 to 2 kg/liter-hour and recycle gas rate being 400 to 2000 standard meters$^3$ per metric ton of the total liquid feed to said hydrovisbreaking;

D. distilling the product of said hydrovisbreaking to remove at least one distillate and to leave behind a residue;

E. feeding a distillate from step D having a boiling range of 200° to 480° C. into a hydrogenation zone containing a hydrogenation catalyst forming a fixed bed, said hydrogenation zone being at a temperature in the range of 360° to 410° C. and at a hydrogen pressure in the range of 130 to 175 bars, the product of said hydrogenation zone being subjected to stabilizing to remove the $C_5$-fraction, from the stabilization product removing a gasoline fraction to produce a diesel oil fraction boiling in the range of 220° to 460° C. and mixing at least a portion of said diesel oil fraction with said hydrocarbon oil of step B as the sole donor solvent.

2. A process according to claim 1, wherein the liquid hourly space velocity in said hydrogenation zone is 0.5 to 2 kg/liter-hour.

3. A process according to claim 1, wherein the liquid hourly space velocity in said hydrogenation zone is 0.8 to 1.5 kg/liter-hour.

* * * * *